US005826878A

United States Patent [19]

Kiyosaki et al.

[11] Patent Number: 5,826,878

[45] Date of Patent: Oct. 27, 1998

[54] APPARATUS AND METHOD OF PLAYING A BOARD GAME FOR TEACHING FUNDAMENTAL ASPECTS OF PERSONAL FINANCE, INVESTING AND ACCOUNTING

[75] Inventors: Robert T. Kiyosaki, Phoenix; Rolf H. Parta, Glendale, both of Ariz.

[73] Assignee: Cashflow Technologies Incorporated, Reno, Nev.

[21] Appl. No.: 748,886

[22] Filed: Nov. 14, 1996

[51] Int. Cl.[6] ..... A63F 3/00

[52] U.S. Cl. ..... 273/256

[58] Field of Search ..... 273/256, 278, 273/240

[56] References Cited

U.S. PATENT DOCUMENTS

| | | | |
|---|---|---|---|
| 4,279,422 | 7/1981 | Shaw | 273/256 |
| 4,378,942 | 4/1983 | Isaac | 273/278 |
| 4,522,407 | 6/1985 | Hatherley | 273/256 |
| 4,840,382 | 6/1989 | Rubin | 273/237 |
| 4,890,844 | 1/1990 | Weiss | 273/249 |
| 4,955,616 | 9/1990 | Ingalls | 273/249 |
| 5,071,135 | 12/1991 | Campbell | 273/256 |

FOREIGN PATENT DOCUMENTS

| | | | |
|---|---|---|---|
| 0298 727 A2 | 1/1989 | European Pat. Off. . | |
| 0382 369 A2 | 11/1990 | European Pat. Off. . | |
| 801964 | 9/1958 | United Kingdom . | |
| 1432761 | 4/1976 | United Kingdom | 273/256 |
| 2196263 | 4/1988 | United Kingdom | 273/256 |

*Primary Examiner*—Benjamin H. Layno
*Attorney, Agent, or Firm*—James H. Phillips; Michael A. Lechter

[57] ABSTRACT

A board game for teaching the principles of personal finance whereby significant wealth may be accumulated includes a playing board having a first, Rat Race, track and an entirely separate second, Fast Track. Each player begins the game on the Rat Race track and is provided with a Game Card to track his/her finances. The Game Card is configured as a combined Income/Balance Sheet, and basic accounting rules of personal finance are carefully followed in updating the Game Card while a player progresses along the Rat Race according to the roll of die. The Rat Race track includes spaces on which a player can land which presents unexpected financial obstacles, but the Rat Race also includes spaces which present financial opportunities. By prudently investing as opportunities arise, a player may obtain passive income in addition to a salary. Once a player's passive income exceeds his/her expenses, the player moves to the Fast Track for further play. On the Fast Track, a player enjoys the greatly improved life of one who has accumulated significant wealth. However, provision is made for unexpected problems in various Fast Track spaces along which a player moves. Thus, a player's ongoing financial condition while on the Fast Track is also carefully updated using basic accounting principles of personal finance. The game is played in accordance with formal rules which include provisions for declaring a winner.

31 Claims, 16 Drawing Sheets

HOUSE FOR SALE - 3BR/2BA

NICE 3/2 HOUSE WITH IN-GROUND POOL
AND FULL APPLICANCES AVAILABLE
IN UPPER MIDDLE CLASS AREA.
GOOD SCHOOLS.

USE THIS YOURSELF
OR SELL TO ANOTHER PLAYER
-65 ROI; MAY SELL FOR $65K TO $150K
COST: $125K MORTGAGE: $105K
DOWNPAY: $20K CASHFLOW: -$100

FIG. 9

WIDGET COMPANY BUYER

ENGINEER/INVENTOR WHO OWNS
PATENTED MACHINERY COMPANY
OFFERS $50K CASH FOR INVENTIVE
METHOD OF MAKING WIDGETS.

ANYONE WHO OWNS A WIDGET
COMPANY MAY SELL AT THIS PRICE.

IF YOU SELL, GIVE UP THE CASH FLOW
YOU CURRENTLY RECEIVE FROM
THIS COMPANY.

FIG. 11

STOCK - OK4U DRUG CO.

BOOMING MARKET RAISES SHARE
PRICE OF THIS LONG TIME
MAKER OF MEDICINES.

ONLY YOU MAY BUY AS MANY
SHARES AS YOU WANT AT THIS PRICE.
EVERYONE MAY SELL AT THIS PRICE.
SYMBOL OK4U
NO DIVIDEND (YIELD OR ROI=0%)
TRADING RANGE: $5 TO $40

FIG. 10

PLAY YOUR LUCKY
LOTTERY NUMBER!
LOSE $100

FIG. 12

FIG. 13

Your Profession

*DOCTOR (MD)*

Please copy all data, excluding 0's, onto your Game Card.

*Goal: To build up your Passive Income to be greater than your Total Expenses.*

| *Income* | |
|---|---|
| Salary: | $13,200 |
| Interest: | 0 |
| Dividends: | 0 |
| Real Estate/Business | 0 |
| (Interest + Dividends + Real Estate/Business is the sum of your Passive Income) | |

| | |
|---|---|
| Passive Income: | 0 |
| **Total Income:** | **$13,200** |

| *Expenses* | |
|---|---|
| Taxes: | 3,420 |
| Mortgage/Rent Pay: | 1,900 |
| School Loan Pay: | 750 |
| Car Payment: | 380 |
| Credit Card Payment: | 270 |
| Retail Payment: | 50 |
| Other Expenses: | 2,880 |
| Child Expenses: | 0 |

(Note: All players begin with 0 children)

| | |
|---|---|
| Per Child Expense: | $640 |
| **Total Expenses:** | **$9,650** |
| **Monthly Cash Flow:** | **$3,550** |

| *Assets* | |
|---|---|
| Savings: | $400 |

| *Liabilities* | |
|---|---|
| Mortgage: | 202,000 |
| School Loans: | 150,000 |
| Car Loans: | 19,000 |
| Credit Cards: | 9,000 |
| Retail Debt: | 1,000 |

FIG. 14

Profession Truck Driver

Player Pat

*Goal: To get out of the Rat Race and onto the Fast Track by building up your Passive Income to be greater than your Total Expenses*

Income Statement

| Income | | |
|---|---|---|
| Salary: | $2500 | |
| Interest: | -0- | |
| Dividends: | 2 BIG | 100 |
| Real Estate: | | Cash Flow |
| | Condo | 140 |
| | 4-Plex | 800 |
| Businesses: | | Cash Flow |
| | Video/Pinball | 1600 |

| Expenses | |
|---|---|
| Taxes: | 460 |
| Home Mortgage: | 400 |
| School Loan Payment: | -0- |
| Car Payments: | 80 |
| Credit Card Payment: | -0- |
| Retail Payment: | -0- |
| Other Expenses: | 570 |
| Child Expenses: | 280 |
| Bank Loan Payments: | 700 |

Auditor Mike

*Person on your right*

Passive Income: $2640
(Interest + Dividends + Real Estate + Business Cash Flows)

Total Income: $5140

Number of Children: 2
(Begin game with 0 Children)
Per Child Expense: 140

You're Out Of The Rat Race

Total Expenses: $2490

Monthly Cash Flow: $2650

Balance Sheet

| Assets | | | Liabilities | | |
|---|---|---|---|---|---|
| Savings: | | | Home Mortgage: | | 38,000 |
| Stocks/Mutual's/CD's | No. of Shares: | Cost/Share: | School Loans: | | -0- |
| GRO4US Fund | 1000 | 30 | Car Loans: | | 4,000 |
| 2 BIG Power Co. | 10 | 13 | Credit Cards: | | -0- |
| Real Estate: | Down Pay: | Cost: | Retail Debt: | | -0- |
| Condo | 4,000 | 40,000 | RE Mortgage: | Condo | 36,000 |
| 4-Plex | 20,000 | 100,000 | | 4-Plex | 80,000 |
| Business: | Down Pay: | Cost: | Liability: (Business) | | |
| Video/Pinball | 20,000 | 100,000 | | Video/Pinball | 80,000 |
| | | | Bank Loan: | | 7,000 |

FIG. 15

Profession _____ Player _____

*Goal: To get out of the Rat Race and onto the Fast Track by building up your Passive Income to be greater than your Total Expenses*

Income Statement

Income

Salary:
Interest:
Dividends:

Real Estate: Cash Flow
5 6

Businesses: Cash Flow

Expenses

Taxes:
Home Mortgage:
School Loan Payment:
Car Payments:
Credit Card Payment:
Retail Payment:
Other Expenses:
Child Expenses:
Bank Loan Payments:

Auditor _____

*Person on your right*

Passive Income: 7
(Interest + Dividends + Real Estate + Business Cash Flows)

Total Income: 8

Number of Children: _____
(Begin game with 0 Children)
Per Child Expense: _____

Total Expenses: _____

Monthly Cash Flow: 9

Balance Sheet

Assets

Savings:
Stocks/Mutual's/CD's No. of Shares: Cost/Share:

Real Estate: Down Pay: Cost:
1 2 3

Business: Down Pay: Cost:

Liabilities

Home Mortgage:
School Loans:
Car Loans:
Credit Cards:
Retail Debt:
RE Mortgage:
4

Liability: (Business)

Bank Loan:

FIG. 16

Profession _____ Player _____

*Goal: To get out of the Rat Race and onto the Fast Track by building up your Passive Income to be greater than your Total Expenses*

*Income Statement*

| *Income* | |
|---|---|
| Salary: | |
| Interest: | |
| Dividends: | |
| Real Estate: | Cash Flow |
| 6 | 7 |
| Businesses: | Cash Flow |

| *Expenses* |
|---|
| Taxes: |
| Home Mortgage: |
| School Loan Payment: |
| Car Payments: |
| Credit Card Payment: |
| Retail Payment: |
| Other Expenses: |
| Child Expenses: |
| Bank Loan Payments: |

Auditor _____

*Person on your right*

Passive Income: 8
(Interest + Dividends + Real Estate + Business Cash Flows)

Total Income: 9

Number of Children: _____
(Begin game with 0 Children)
Per Child Expense: _____

Total Expenses: _____

Monthly Cash Flow: 10

*Balance Sheet*

| *Assets* | | | *Liabilities* |
|---|---|---|---|
| Savings: | | | Home Mortgage: |
| Stocks/Mutual's/CD's | No. of Shares: | Cost/Share: | School Loans: |
| | | | Car Loans: |
| | | | Credit Cards: |
| Real Estate: | Down Pay: | Cost: | Retail Debt: |
| | | | RE Mortgage: |
| 2 | 3 | 4 | 5 |
| Business: | Down Pay: | Cost: | Liability: (Business) |
| | | | Bank Loan: |

FIG. 17

Profession _____ Player _____

*Goal: To get out of the Rat Race and onto the Fast Track by building up your Passive Income to be greater than your Total Expenses*

*Income Statement*

*Income*

Salary:
Interest:
Dividends: 4
Real Estate: Cash Flow
Businesses: Cash Flow

*Expenses*

Taxes:
Home Mortgage:
School Loan Payment:
Car Payments:
Credit Card Payment:
Retail Payment:
Other Expenses:
Child Expenses:
Bank Loan Payments:

Auditor _____

*Person on your right*

Passive Income: 5
(Interest + Dividends + Real Estate + Business Cash Flows)

Total Income: 6

Number of Children: _____
(Begin game with 0 Children)
Per Child Expense: _____

Total Expenses: _____

Monthly Cash Flow: 7

*Balance Sheet*

*Assets*

Savings:
Stocks/Mutual's/CD's No. of Shares: Cost/Share:
1 2 3
Real Estate: Down Pay: Cost:
Business: Down Pay: Cost:

*Liabilities*

Home Mortgage:
School Loans:
Car Loans:
Credit Cards:
Retail Debt:
RE Mortgage:
Liability: (Business)
Bank Loan:

FIG. 18

Profession _____ Player _____

*Goal: To get out of the Rat Race and onto the Fast Track by building up your Passive Income to be greater than your Total Expenses*

*Income Statement*

Income

Salary:
Interest:
Dividends:
5
Real Estate: Cash Flow
Businesses: Cash Flow

Expenses

Taxes:
Home Mortgage:
School Loan Payment:
Car Payments:
Credit Card Payment:
Retail Payment:
Other Expenses:
Child Expenses:
Bank Loan Payments:

Auditor _____

*Person on your right*

Passive Income: 6
(Interest + Dividends + Real Estate + Business Cash Flows)

Total Income: 7

Number of Children: _____
(Begin game with 0 Children)
Per Child Expense: _____

Total Expenses: _____

Monthly Cash Flow: 8

*Balance Sheet*

Assets

Savings:
Stocks/Mutual's/CD's No. of Shares: Cost/Share:
2 3 4
Real Estate: Down Pay: Cost:
Business: Down Pay: Cost:

Liabilities

Home Mortgage:
School Loans:
Car Loans:
Credit Cards:
Retail Debt:
RE Mortgage:
Liability: (Business)
Bank Loan:

FIG. 19

*Congratulations!*
*You are out of the Rat Race!*

*Name* _____

*Auditor* _____
*Person on your right*

*New Goal:*

1) Buy your "Dream" by landing on the Fast Track space you selected at the start of the game and purchasing it.
2) Buy other Players' Dreams (which eliminates them from the game.)
3) Increase Your Monthly Cash Flow by buying businesses.

*You win if:* a) After all the pre-selected Dreams are bought, you are the only person who has their chosen Dream.

-orb) Once all the pre-selected Dreams are bought, if more than one Player has their Dream, then the Player with their Dream AND the highest Monthly Cash Flow wins.

*Your Buyout*

| | |
|---|---|
| Your Passive Income (from other side) *(Rounded to Nearest Thousand Dollars)* | = $ _____ |
| Buyout Ratio | X 100 |
| Your New Cashflow Day Income | = $ _____ |

*You receive 100x your Passive Income because:*

You have sold all your investments from the Rat Race for great profits. You've reinvested that money and have had 10 years of investment success. You've increased your Passive Income by 100 times!

*Your Dividend Day Income*

Beginning Cashflow Day Income: $ _____

| Business | Cash Flow | New Total Income |
|---|---|---|
| | | |

Cashflow Day Income is equal to your New Cashflow Day Income plus the Cash Flow from every Business you buy on the Fast Track.

APPARATUS AND METHOD OF PLAYING A BOARD GAME FOR TEACHING FUNDAMENTAL ASPECTS OF PERSONAL FINANCE, INVESTING AND ACCOUNTING

FIELD OF THE INVENTION

This invention relates to the art of board games and, more particularly, to a board game which teaches a comprehensive understanding of fundamental aspects of personal finance, investing and the relevant aspects of accounting and which further extends this teaching to an understanding of the principles upon which significant wealth may be accumulated.

BACKGROUND OF THE INVENTION

It is well known that most individuals and families have difficulty in handling personal finances so as to accumulate significant wealth; indeed, most individuals and families deem the attainment of wealth an impossible goal to achieve and do not even seriously consider the possibility. It is their belief that all their income must be dedicated to the ongoing requirements of life, and they consider themselves fortunate if they can retire after many years of labor based upon some sort of pension augmented with Social Security or the like. Often, such retirements turn out to be insufficiently funded such that a "retired" person may be forced to continue to work, at least part time, and a mature retired couple may find their standard of living reduced and yearly deteriorating as the effects of inflation and other factors, such as increased medical costs, take effect.

Nonetheless, a few individuals and families do, over a period of time and with the application of certain principles, attain wealth and are thus able to eliminate or greatly reduce the necessity to work at a formal job and are also able to realize their individual "dreams" of the sort that require such wealth. Correspondingly, they also achieve the sort of long term security that results from the elimination of financial worries.

The differences between those individuals and families who are able, over time, to accumulate substantial wealth (live on the Fast Track) and those who do not (and thus are doomed to live the so-called lives of quiet desperation; i.e., life in the Rat Race) is that the former somehow understand the dynamics of personal finance and investing. This understanding may be more or less self taught or intuitive, and the degree of success of a given individual or family usually depends upon just how well the dynamics of personal finance are really understood.

These principles of personal finance, investing, accounting and the accumulation of wealth can be taught although they are certainly not taught in most formal institutions of learning and are, to some extent, inconsistent with the hard work ethic practiced by the majority of individuals and families. Of course, hard work is almost always a start to the accumulation of wealth, but it can be demonstrated that it is not necessary for one to work hard all his/her life if the known principles of personal finance, investing and accounting leading to the accumulation of wealth are carefully practiced.

These principles are sometimes taught in expensive and time-consuming seminars. Or, they may be taught in more or less well written books. Some individuals, however, do not have the time or ability to spend the sums needed or even the inclination to attend such seminars or the ability to learn the principles from a book.

Thus, it will be readily apparent that it would be highly desirable to provide a means by which the principles of personal finance, investing, accounting and the accumulation of wealth can be taught in a highly compressed time frame and in a manner that is both fun and, learning wise, highly effective. It is to these ends that the present invention is directed.

OBJECTS OF THE INVENTION

It is therefore a broad object of this invention to provide a board game which teaches fundamental aspects of personal finance.

Similarly, it is a broad object of this invention to provide a board game which teaches fundamental aspects of investing.

It is another object of this invention to provide a board game which also teaches fundamental aspects of accounting as applied to personal finance.

It is yet another object of this invention to provide a board game which further teaches the process of accumulating significant wealth.

From another point of view, it is an object of this invention to provide a board game which teaches the foregoing fundamental aspects of personal finance, investing and accounting and the process of building and accumulating significant wealth in greatly compressed time.

From yet another point of view, it is an object of this invention to provide a board game which teaches the power of passive income and how passive income is obtained.

From still another point of view, it is an object of this invention to provide a game board which includes dual, Rat Race and Fast Track, life tracks and which includes rules and accessories for teaching the science of personal finance, investing basic accounting and the accumulation of significant wealth.

It is also an object of this invention to provide a game board in which a Player moves first on a Rat Race track and then, upon qualification, moves to an entirely separate Fast Track to thereby provide a sequential experience.

It is a further object of this invention to provide such a board game in which the teachings resulting from play are essentially self learned and do not require the intervention of an instructor.

SUMMARY OF THE INVENTION

Briefly, these and other objects of the invention are achieved by the provision of a board game which includes a first, Rat Race, track and an entirely separate second, Fast Track. Each player is assigned, at the beginning of game play, a profession which includes certain beginning financial information including the cost of living for that player and other ongoing financial information. In addition, each player selects a Dream on the Fast Track which he/she hopes to eventually obtain; attainment of a player's selected Dream is significant to keeping score and determining the winner of a given game. Each player is also provided with a Game Card on which to enter his/her beginning financial information and also updates as play proceeds while the player is confined to the Rat Race track. The Game Card is configured as a combined Income/Balance Sheet, and basic accounting rules of personal finance are carefully followed in updating the Game Card. A player progresses along the Rat Race track in accordance with rolls of dice. The Rat Race includes spaces on which a player can land which, for example, presents unexpected financial obstacles set forth on Doodads playing cards, but the Rat Race also includes spaces on which a player may take advantage of financial opportunities set forth on Opportunity and The Market playing cards. The Rat Race track thus represents the life of ordinary working individuals.

By prudently investing as opportunities permit and tracking such investments on the Game Card in the context of combining, on a single score sheet, not only day-to-day income and expenses, but also passive income which may be realized and grown from investments, a player's passive income can be grown. Once a player's passive income exceeds his/her expenses, the player moves to the Fast Track for further play.

On the Fast Track, a player enjoys the greatly improved life of one who has accumulated significant wealth and may seek to obtain his/her (and other player's) Dream. However, as in real life, even life on the Fast Track is not without problems, and provision is made for such in the various Fast Track spaces along which a player moves in accordance with rolls of dice. A player's progress in life on the Fast Track is followed (again, carefully following the basic accounting rules for personal finance) on a Game Card which is adapted to such life and is therefore somewhat different from the Game Card used to follow the same player's earlier progress in the Rat Race. Formal rules set forth the sequence and conditions of play and the conditions under which a winner of the game emerges. Repetitive playing of the game and consequent improved performance teaches a player the principles of accumulating significant wealth.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

FIG. 9 is an illustration of an exemplary Big Deal card;

FIG. 10 is an illustration of an exemplary Small Deal card;

FIG. 11 is an illustration of an exemplary The Market card;

FIG. 12 is an illustration of an exemplary Doodads card;

FIG. 13 is an illustration of an exemplary Profession card;

FIG. 14 is an example of a Game Card used by each player in tracking that player's performance in playing the game while in the Rat Race;

FIG. 15 is an example of a Game Card used by each player showing the appropriate entries for purchasing real estate investments while in the Rat Race;

FIG. 16 is an example of a Game Card used by each player showing the appropriate entries for selling real estate investments while in the Rat Race;

FIG. 17 is an example of a Game Card used by each player showing the appropriate entries for purchasing stocks, mutual funds, CDs and the like while in the Rat Race;

FIG. 18 is an example of a Game Card used by each player showing the appropriate entries for selling stocks, mutual funds, CDs and the like while in the Rat Race; and FIG. 19 is an example of a Game Card used by each player in tracking that player's performance in playing the game while on the Fast Track.

DESCRIPTION OF THE PREFERRED EMBODIMENT(S)

Figure 1:
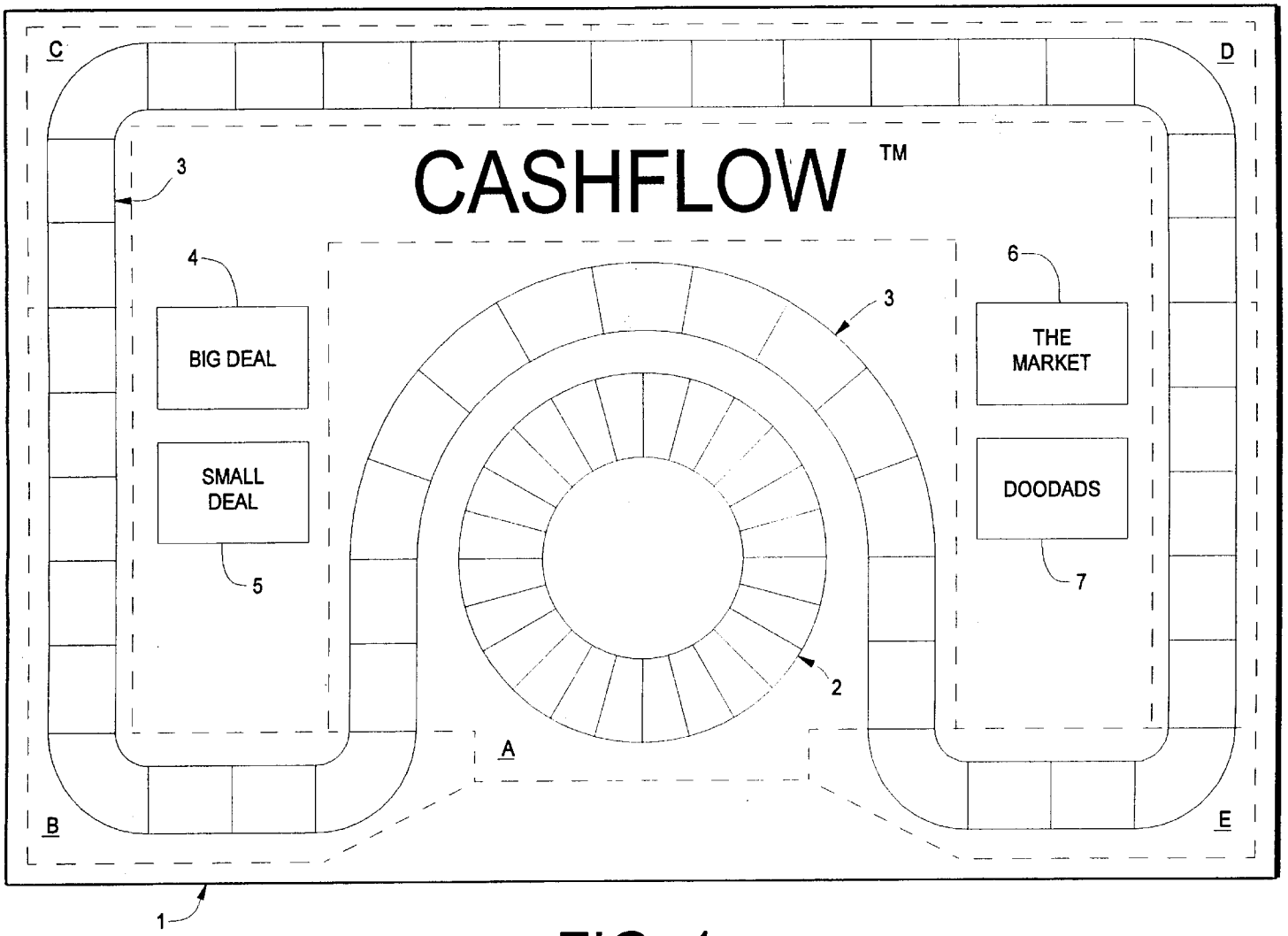
FIG. 1 is a generalized view of a game board for playing the subject game.

Attention is first directed to FIG. 1 which is a generalized representation of a game board 1 for playing the subject game. A fundamental characteristic of the game board 1 is that there are two tracks for the players to move along: a Rat Race track 2 and a Fast Track 3. As will be discussed further below, play starts for all players on the Rat Race which is representative of the life of many working individuals and families. With skill in handling life and finances on the Rat Race track 2, a player may qualify to move to the Fast Track 3 in which life is much more secure and enjoyable, although not without potential difficulties which must be managed. On both the Rat Race track and the Fast Track, the game forces a player to practice both financial and investing skills and the accounting skills which highlight what is actually happening to a player's finances to bring about success or failure in the game. Thus, the Rat Race and the Fast Track, including uncertainties and unexpected events, emulates life such that the skills necessary to practice the lessons learned in playing and becoming more expert at the game may be transferred to real life experiences.

In addition to the Rat Race track 2 and the Fast Track 3, the game board 1 includes spaces for four types of cards which may be drawn from time to time by players as they land on various track spaces. Two of these card types, Big Deal cards disposed on space 4 and Small Deal cards on space 5 are collectively known as Opportunity cards. Space 6 is for the market cards and space 7 is for Doodads cards, all as will be explained more fully below.

Each of the spaces shown in FIG. 1 on the Rat Race track 2 and the Fast Track 3 has indicia which is too small to show in FIG. 1. However, the game board 1 is broken up into sections for purposes of illustration as indicated by the segments designated A, B, C, D and E which are separated by dashed lines which have no other purpose. Thus, it will be understood that the designators A, B, C, D and E and the dashed lines are not part of the game board.

Figure 2:
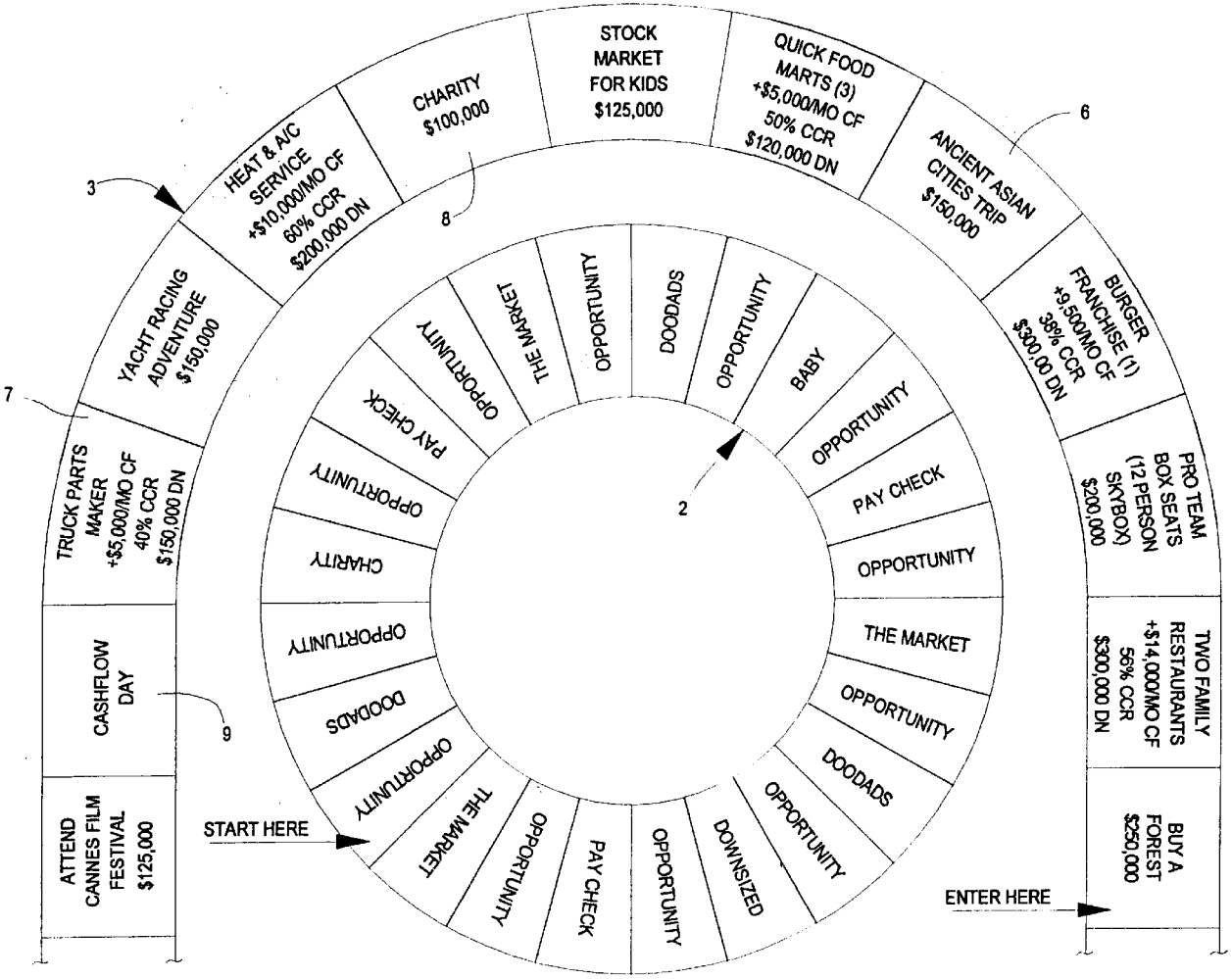
FIG. 2 is a view of a first part of the game board shown in FIG. 1 enlarged to show certain indicia provided in playing spaces.

Referring to FIG. 2 (designator A in FIG. 1), it will be seen that the circular Rat Race track includes segments marked Opportunity, Doodads, Charity, Pay Check, The Market, Baby and Downsized. While Opportunity appears every other space around the Rat Race, the remaining space categories are less frequently distributed. It will also be noted that one of the Opportunity spaces has an arrow marked "Start Here". As will be explained more completely below in the discussion of the game rules, this space is the starting point for play by all the players.

Also shown in FIG. 2 is a fragment of the Fast Track 3 which is in the region of the Rat Race track 2. Because of space considerations, legends appearing in the Fast Track spaces are somewhat abbreviated in some instances. However, it will be observed that the Fast Track spaces variously include: Dreams such as "Ancient Asian Cities Trip" 6 for $150,000 in which indicia, not shown in FIG. 2, further states "A private plane & private guide take you & 5 friends to the most remote spots of Asia . . . where no tourists have gone before."; Business Opportunities such as Truck Parts Maker 7; Charity 8; and CashFlow Day 9, all to be discussed further below.

Figure 3:
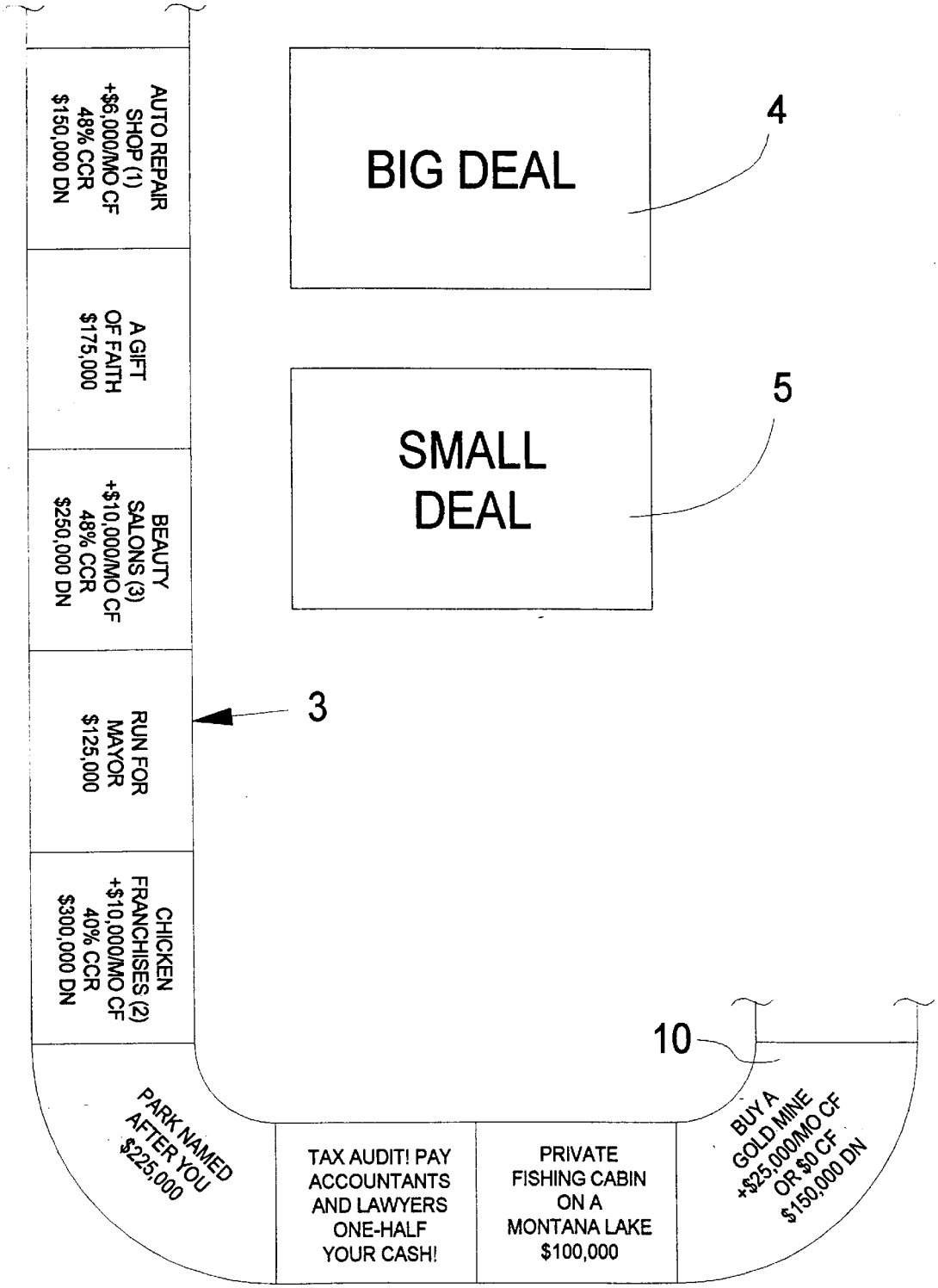
FIG. 3 is a view of a second part of the game board shown in FIG. 1 enlarged to show certain indicia provided in playing spaces.
Figure 4:
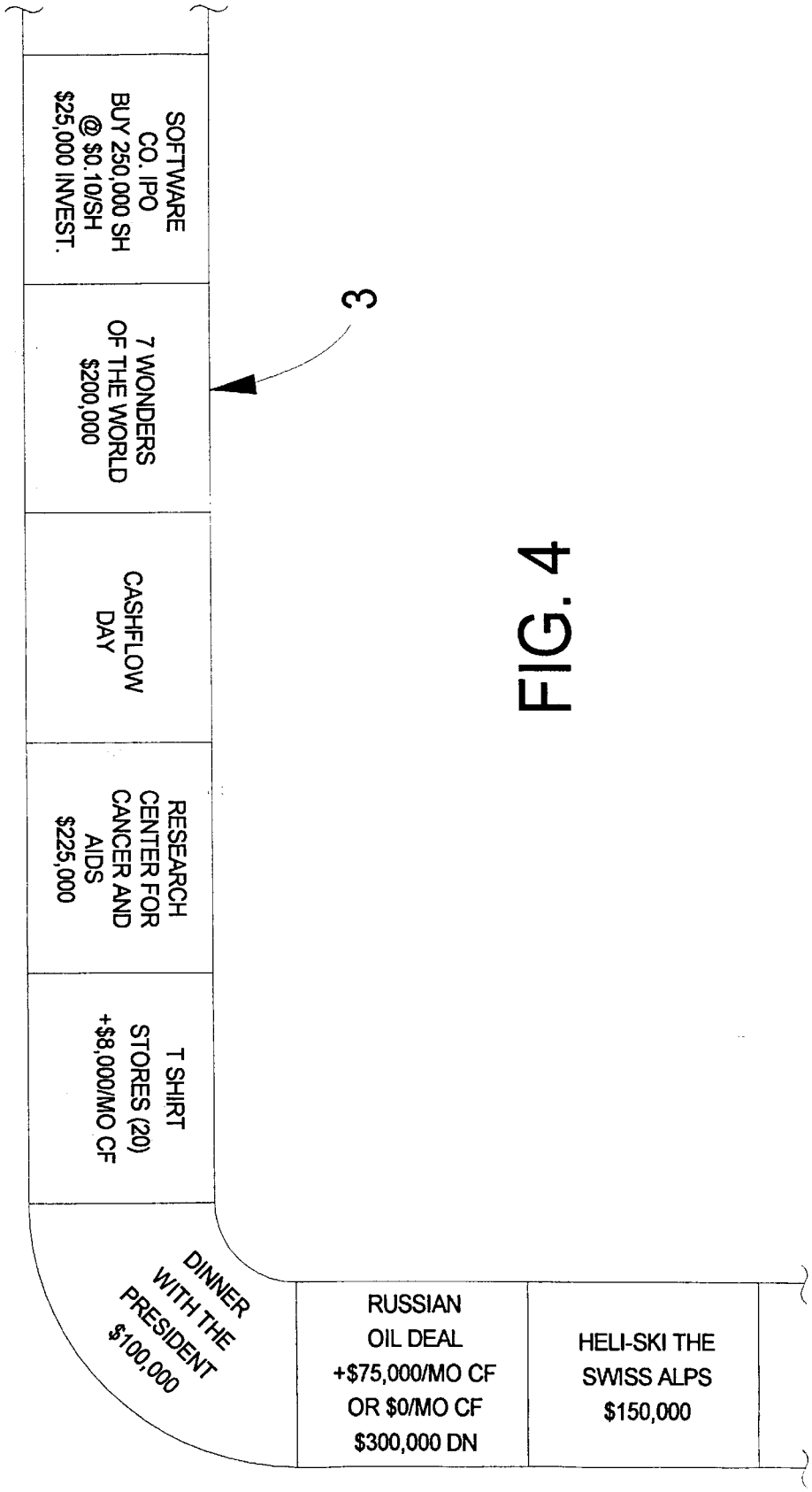
FIG. 4 is a view of a third part of the game board shown in FIG. 1 enlarged to show certain indicia provided in playing spaces.
Figure 5:
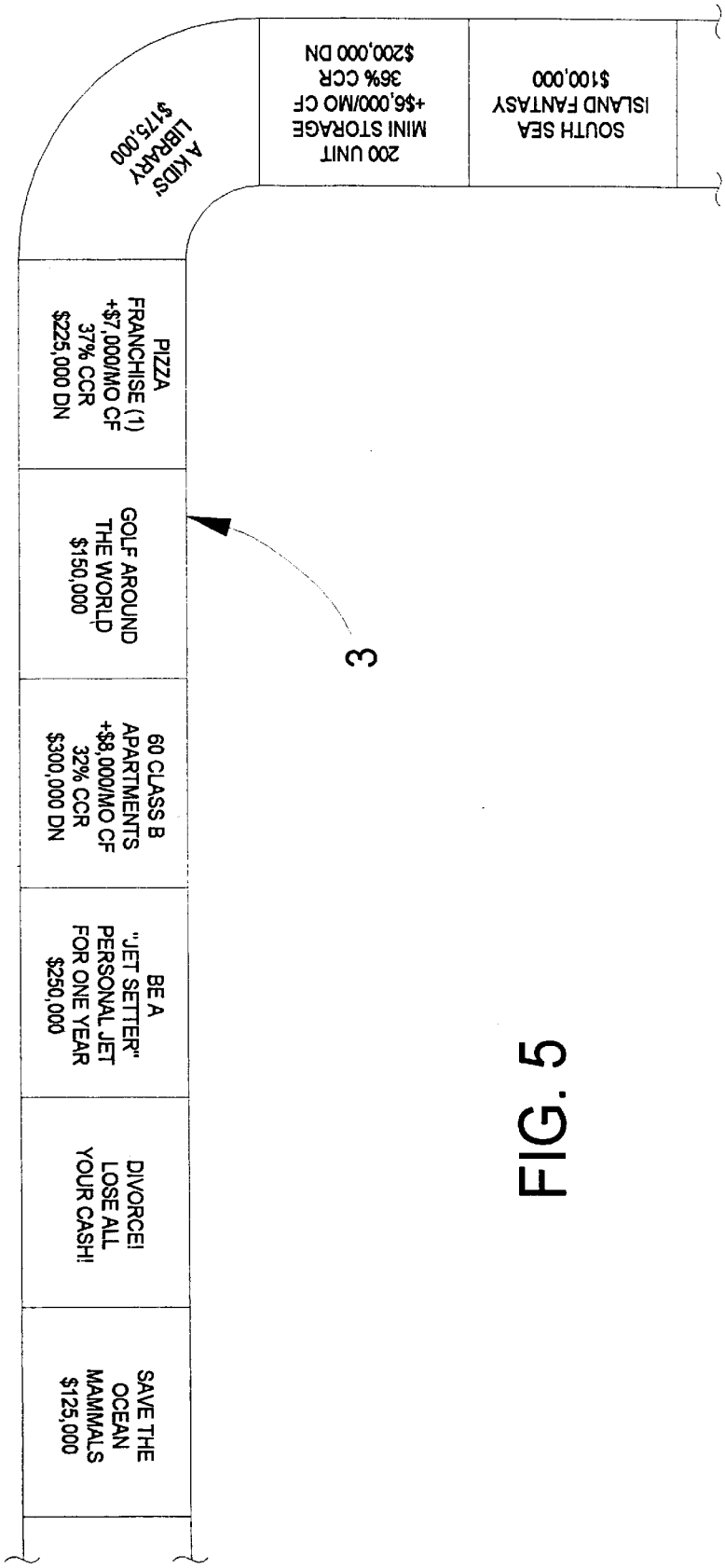
FIG. 5 is a view of a fourth part of the game board shown in FIG. 1 enlarged to show certain indicia provided in playing spaces.
Figure 6:
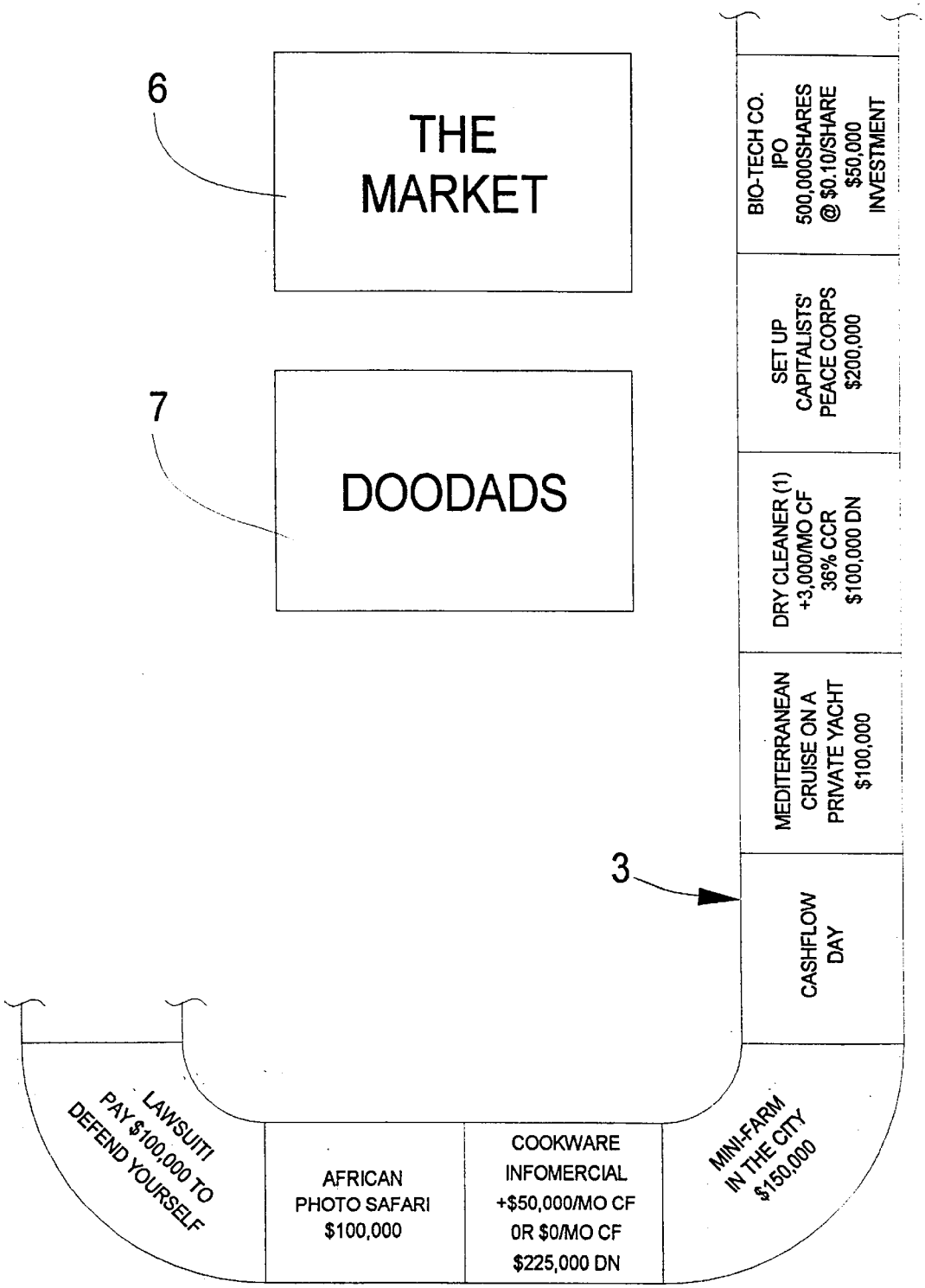
FIG. 6 is a view of a fifth part of the game board shown in FIG. 1 enlarged to show certain indicia provided in playing spaces.

FIG. 3 is an enlarged view of section B (FIG. 1) of the Fast Track 3. Attention is particularly directed to the "Buy a Gold Mine" business opportunity space 10 which states "+25,000/MO CF (i.e., Cash Flow) OR $0/MO CF" and "$150,000 DN". Additional indicia, not shown in FIG. 3 because of space considerations, but shown in the further enlarged view of FIG. 7, explains the two possibilities for monthly cash flow as follows: "+25,000/MO CF if you roll 3 or higher on 1 die, or else $0/MO CF". Several of the business opportunity spaces around the Fast Track 3 have similar variable possibilities and uncertainties for cash flow realized from an investment.

Figure 7:
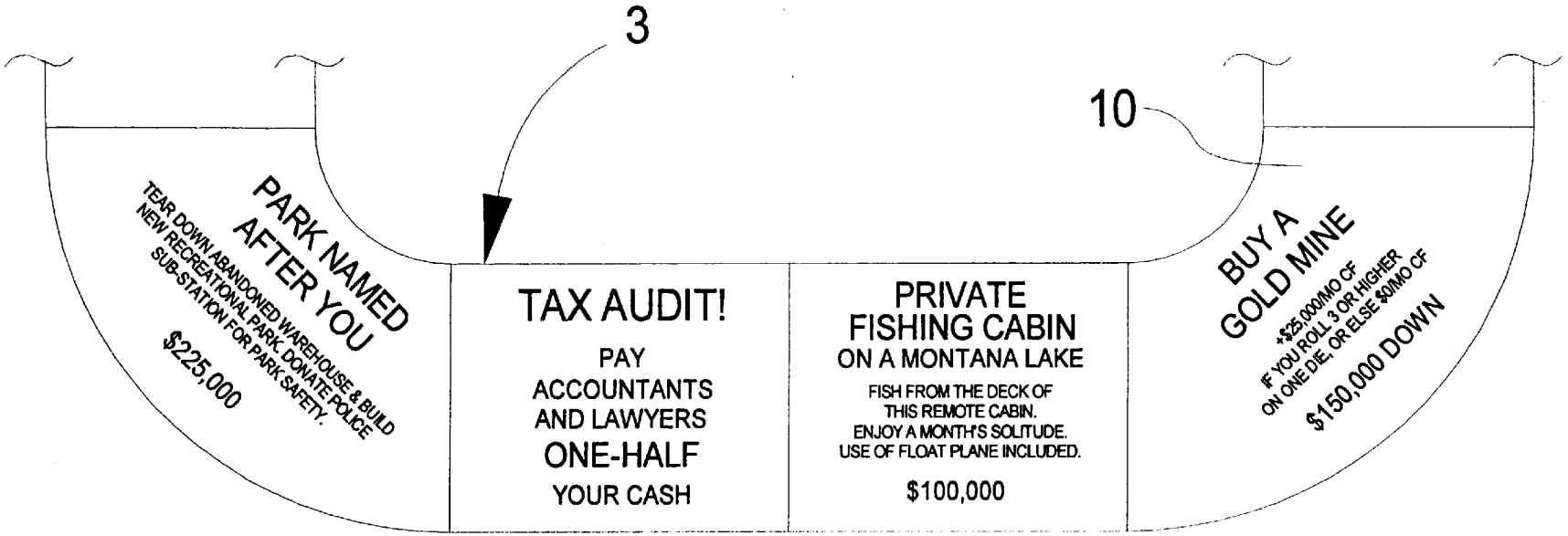
FIG. 7 is a view of a fragment of the second part of the game board shown in FIG. 3 further enlarged to show additional indicia provided in playing spaces.

FIGS. 2, 3, 4, 5, and 6, taken together, show the complete Fast Track 3 and the abbreviated versions of the more complete legends which appear in the various spaces on an actual game board. FIG. 7 shows additional samples of complete legends for Fast Track 3 spaces.

Space colors are an important subtle psychological aspect of the game. On the Rat Race track 2, Opportunity spaces are preferably a pale green suggesting the potential for income, and The Market spaces are preferably a pale blue suggesting a potential for cash via the sale of assets. On the other hand, Doodads are preferably a pale red, and Downsized and Baby are preferably shades of pale purple to suggest the negative effect on family cash flow. For contrast, Pay Check may be a pale yellow and Charity a pale orange.

Similarly, on the Fast Track 3, Business Opportunity spaces are preferably a pale green to suggest the probably positive effect on cash flow, Dreams and problem area spaces (e.g., Lawsuit and Divorce) are a pale red to suggest the negative effect on cash flow. CashFlow Day and Charity are, respectively, pale yellow and pale orange for contrast.

Figure 8:
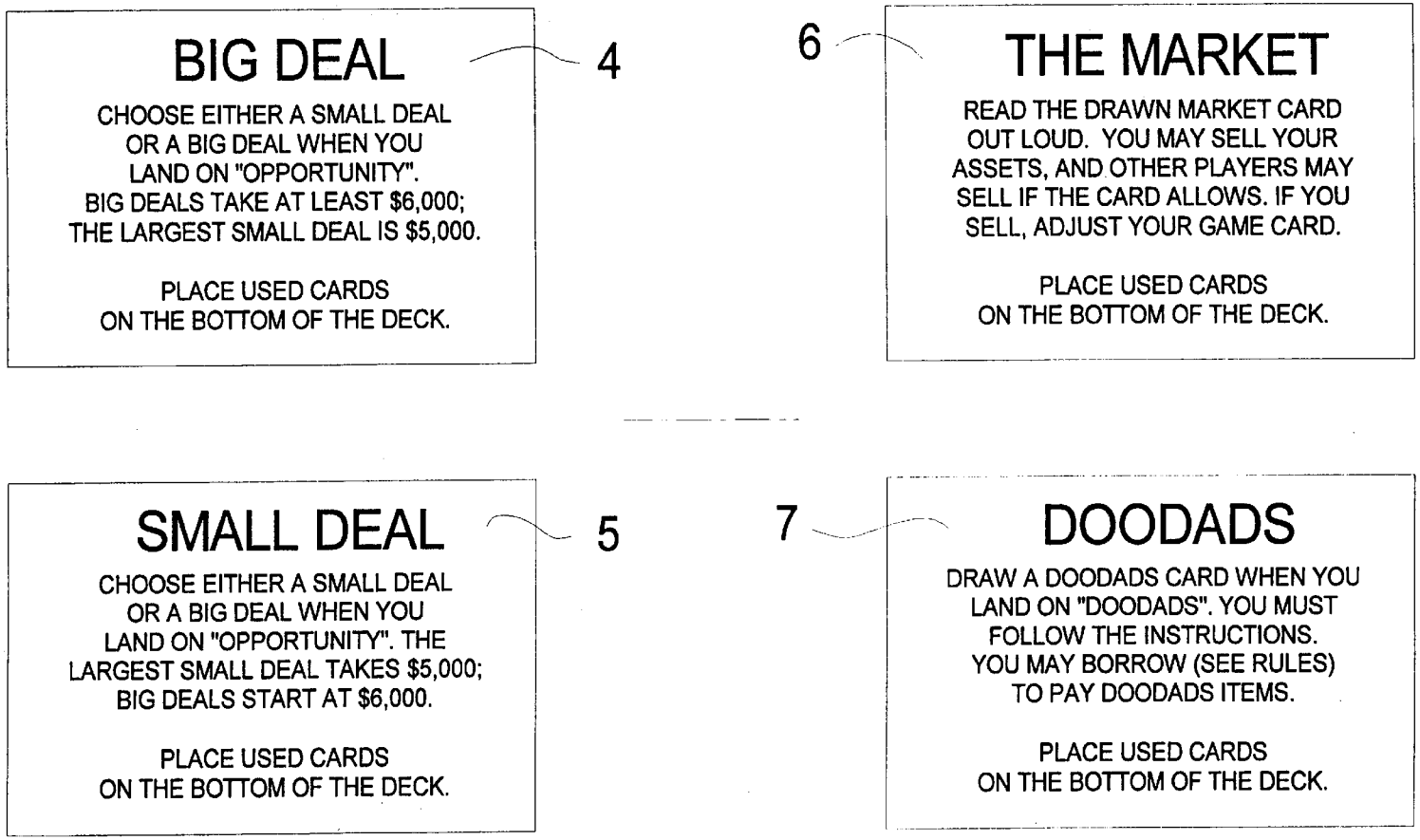
FIG. 8 is an enlarged view of portions of the game board shown in FIG. 1 showing certain indicia in each of four spaces, Big Deal, Small Deal, The Market and Doodads, reserved for corresponding card types to be drawn during play.

FIG. 8 illustrates the indicia on the Big Deal 4, Small Deal 5, The Market 6 and Doodads 7 spaces for placing the corresponding cards. FIG. 9 shows an exemplary Big Deal card 11. Similarly, FIG. 10 shows an exemplary Small Deal card 12, FIG. 11 shows an exemplary The Market card 13 and FIG. 12 shows an exemplary Doodads card 14.

FIG. 13 illustrates an exemplary Profession card and the information included with each.

Glossary of Terms Used in Playing the Subject Game

Asset—Something that puts money "in a Player's pocket", with minimum labor.

Automated Business—A business which is run primarily by technology rather than people.

Balance Sheet—A snapshot of a Player's assets and liabilities.

Capital—Generally called cash or something having an agreed-upon value.

Capital Gain/Loss—The difference between what a Player paid for an investment and what he/she sold it for.

Cash Flow (CF)—Cash coming in (as income) and cash going out (as expenses). It is the direction of Cash Flow that determines whether something is Income, Expense, Asset or Liability. Cash Flow tells the story.

Cash Offer Vs. Financed Offer—Someone paying all cash versus someone paying a down payment and financing the remainder.

Certificate of Deposit (CD)—A loan to government or a business, issued through a bank, with specified maturity dates and interest rates.

Dividend—A payment of profits of a company to the shareholders.

Doodads—Expenses that simply take money out of a Player's pocket. For example, most items purchased in shopping centers are Doodads.

Down Payment—A percentage of the purchase price a Player pays for an investment. The remainder of the price is then financed through other means.

Foreclosure—A bank or individual takes a Player's property for non-payment of Mortgage.

Government Savings Bond—A loan a Player makes to the federal government in exchange for payment of interest on that loan.

Income Statement—A form showing a Player's Income and Expenses over a period of time. Also called a Profit and Loss Statement.

Inflation—An economic situation where consumer prices rise sharply.

IPO—Initial Public Offering: the first time a company offers shares of stock to the general public.

Liability—Something that takes money "out of a Player's pocket".

Limited Partnership—A legal entity set up to hold Assets. Allows limited liability with majority of control.

Mortgage—If a Player finances the purchase of real estate, the property being financed is used as Collateral against the amount of money being financed.

Mutual Fund—A variety of stocks, bonds and/or securities, grouped together, managed by a professional investment company and purchased by individual investors through shares. The shares possess no ownership value in the various companies in a given Mutual Fund.

REIT—Real Estate Investment Trust: similar to a Mutual Fund; deals solely in Real Estate.

ROI—Return On Investment: annual Return of Capital, as a percentage, from an investment. For example: an apartment building costs $500,000. A Player pays $100,000 as a Down Payment. A monthly Cash Flow of $2000 is obtained. The ROI is $2,000×12 divided by $100,000=24%.

Shares Split—When the number of shares in a given investment owned by a Player increases and the price per share decreases. Also known as a stock split.

Stock Share—A share of stock represents ownership in a corporation. The shareholders (those owning Stock in a corporation) are the actual owners of that corporation.

Tax Lien (Property)—A legal claim on a property for unpaid taxes.

1031 Tax-Deferred Exchange—A method of buying and selling real estate that allows a Player to defer payment of tax on Capital Gains.

The Market—Where items of value are bought and sold.

Trading Range—The difference between the highest and lowest price of an investment.

Yield—Amount a Player actually earns from a stock, bond, mutual fund, CD, etc. Similar to ROI.

While the foregoing definitions of financial terms are somewhat simplified, they are adequate for playing the subject game and gaining the financial insight to which it is directed. Consider now the playing of the subject game itself.

Rules of the Subject Game

The game is played in two parts: the Rat Race and the Fast Track.

Part I—The Rat Race

Each Player's goal is to get out of the Rat Race and onto the Fast Track. The Rat Race represents the ongoing life experience of most people and families. To get out of the Rat Race, a Player must buy investments which gives him/her cash flow (or passive income) so that the Player's Passive Income is greater than his/her Total Expenses.

Part II—The Fast Track

Once a Player has successfully moved from the Rat Race to the Fast Track, the Player's goal is to: 1) Buy his/her Dream, 2) Buy other Players' Dreams and 3) Increase his/her Monthly Cash Flow.

If a Player successfully buys another Player's Dream, then the Player who has lost his/her Dream is eliminated from the game and condemned to the Rat Race for life.

The game ends when all the Dreams have been purchased. A given Player wins the game if:

1) After all the Players' Dreams have been purchased, the given Player is the only person who has obtained his/her chosen Dream. Each of the other Players will have been eliminated because his/her Dream was bought by another player.

Or

2) After all the Players' Dreams have been purchased, if more than one Player has obtained his/her Dream, then the Player with his/her Dream AND the highest monthly cash flow wins.

How To Set Up The Game

1) The Players "elect" one Player to act as Banker in addition to playing. The Banker should be someone good with numbers and able to handle cash transactions quickly. The Banker must keep his/her personal money separate from the funds of the Bank. The Banker pays and receives all moneys to and from Players and lends money to Players (see "Bank Loan").

2) Separately shuffle the "Big Deal" and "Small Deal" (both "Opportunity") cards and "The Market" and "Doodads cards" and place them face down on the game board on their respective marked places.

3) Distribute one Income Statement/Balance Sheet to each Player. As shown in FIG. 14, this is a Player's "Game Card" while he/she is in the Rat Race. Distribute a marker pen to each Player for use in preparing and updating his/her Game Card. (Preferably, Game Cards have glossy surfaces such that they can be reused and are also reversible with one side to be used while a Player is in the Rat Race and the other side to be used when a Player enters the Fast Track. Alternatively, the Game Cards can be single use, typically printed on a pad of numerous blank Game Cards.) The configuration of the Fast Track Game Card will be discussed below.

4) Any Player may shuffle the "Profession" cards and randomly deal one, face down, to each Player. Each Player then turns over his/her Profession card and enters the information on it, exactly as it's written, onto his/her Game Card. FIG. 13 illustrates an exemplary "Profession" card.

5) Meet your Auditor—this is the person on each Player's right. An Auditor's role is to assist his/her "client" in making accurate calculations. Each time a change is made to a Player's Game Card, that Player's Auditor must check the resulting calculations. If figures need to be re-worked, then the Player's Auditor should call a short time-out to make corrections.

6) The Banker distributes starting cash (i.e., conventional "play money") to each Player. The amount of cash each Player receives at the beginning of the game is:

a) The Player's Monthly Cash Flow (income minus expenses, on his/her Game Card).

plus b) The Player's Savings (listed on his/her Game Card). Note: Savings is only received by a Player at the beginning of the game. Savings is not part of a Player's Pay Check.

To begin the game:

1) Each Player chooses two like-colored playing pieces and a set of like-colored (same color) tokens.

2) Each Player selects a "Dream" on the Fast Track and places one of his/her playing pieces on the selected Dream. This signifies that Player's Dream goal. (Each Player wants to buy his/her Dream on the Fast Track. If another Player buys a given Player's Dream, that given Player is eliminated from the game). Each Player places his/her other playing piece on the Opportunity space designated "Start Here" on the circular Rat Race track.

3) Each Player rolls two dice, and the Player with the highest total count has the first turn. Play then successively passes to the Player on the left. (The order of play remains the same whether individual Players are in the Rat Race or on the Fast Track).

4) Each Player in the Rat Race rolls only one die on his/her turn (unless, as discussed elsewhere in the Rules, a Player donates to Charity while in the Rat Race). The first Player rolls the die and moves around the Rat Race in a clockwise direction. The other Players follow. (Landing on the same space as another Player has no effect on either Player.)

5) If a Player lands on an "Opportunity", a "The Market" or a "Doodads" space, he/she draws a corresponding card. For other spaces landed on, follow the directions stated in the individual spaces.

The Rate Race

Spaces on the Rat Race Track

Pay Check—Each time a Player lands on or passes "Pay Check", the Player receives his/her Monthly Cash Flow from the Bank. If this amount is negative (minus), the Player must pay it to the Bank. The period from Pay Check to Pay Check is one month. If a Player forgets to ask for his/her Pay Checks the Player loses it.

Opportunity—When a Player lands on an "Opportunity" space, he/she may choose to draw either a "Small Deal" or a "Big Deal" card. The largest Small Deal costs $5,000 to get into, and Big Deals begin at $6,000. Small and Big Deals include a variety of investment opportunities which Players may or may not choose to invest in. Read the "Opportunity" card aloud. Some Deals may allow Players, other than the Player who drew the "Opportunity" card, to buy or sell into the Deal as well. Any investment a Player buys may be sold only if a space, a card or the Rules specifically permit it.

Selling an "Opportunity" Card. If a Player who draws an "Opportunity" card does not want to buy into the Deal, then that Player may sell the card and Deal to another Player at whatever price may be negotiated between the two Players. Only cards that indicate that a Player can sell the card and corresponding Deal to another Player may be sold. (Players may not team up with other Players to buy investments.) Once an "Opportunity" card has been played, it is placed on the bottom of the Large Deal or Small Deal deck from which it was drawn.

The Market—When a Player lands on a "The Market" space, a "The Market" card is drawn, and the card is read aloud. All Players who have the exact asset mentioned on the card may sell at the specified price. If a Player sells an asset, his/her Game Card must be adjusted accordingly. After a "The Market" card has been played, it is placed on the bottom of the deck.

Doodads—When a Player lands on a Doodads space, a Doodads card is drawn, and the directions on the card are followed. The Player may borrow from the Bank (see Bank Loans) to pay Doodad bills. The drawn Doodads card is then placed on the bottom of the deck.

Charity—Charity is optional. Upon landing on "Charity", a Player may choose to give 10% of his/her monthly Salary to Charity (i.e., pay it to the Bank) in exchange for the use of two dice on each of his/her next three turns. (Note that this may be an opportunity to pass Pay Check more often on each roll.)

Baby—When a Player lands on "Baby", that Player has a new addition to his/her family. (There is a limit of three children per Player.) Upon landing on "Baby", a Player must immediately do the following (unless he/she already "has" three children):

a) Add the "Per Child Expense" stated on his/her Game Card to "Child Expenses" on his/her Income Statement;

b) Take into account the "Per Child Expense" to reach a new Total Expenses figure;

c) Reduce Monthly Cash Flow by the "Per Child Expense"; and d) Have his/her Game Card audited.

Downsized—If a Player lands on "Downsized", that Player has lost his/her job. The Player must pay the Bank ½ his/her Salary and also loses two turns. Landing on "Downsized" ends the effect of Charity if the affected Player had earlier taken the Charity option.

Other Options Available to Players in the Rat Race

Paying Off Debt:

A Player may pay off debt to reduce his/her Total Expenses. The Player must pay off the total amount of the selected debt. Partial payments, except for Bank loans, (see Bank Loans) are not allowed. A Player may do this on any turn.

If a Player pays off a debt, his/her Game Card is modified as follows:

(a) Adjust the amount of Income Statement Expenses.

(b) Adjust the amount of Total Expenses.

(c) Adjust the amount of Monthly Cash Flow.

(d) Have his/her Auditor check the revised Game Card.

Bank Loans may be paid off in units of $1,000. Each $1,000 unit of Bank Loan paid off reduces that Player's Monthly Total Expenses by $100. If a Player pays off part of a Bank Loan, in addition to the steps above, the Bank Loan figure on his/her Balance Sheet is accordingly modified.

Bank Loans: A Player may choose to borrow money from the Bank. Loans are in units of $1,000 at 10% interest per month (per Pay Check). Thus, the monthly interest expense is $100 for every $1,000 borrowed.

When a Player takes a Bank Loan:

(a) Receive the amount borrowed from the Bank.

(b) Add the Bank Loan to the Balance Sheet under "Liabilities".

(c) Add the Bank Loan payment (10% of the amount borrowed) to the Income Statement Expenses.

(d) Adjust Total Expenses.

(e) Adjust Monthly Cash Flow.

(f) Have the figures audited.

Bankruptcy: If a Player's expenses are greater than his/her income (the Player's Monthly Cash Flow is negative), he/she may choose to declare bankruptcy. If a Player decides to go bankrupt, then the Player must:

(a) Sell his/her assets for ½ their Down Payment value.

(b) Use the proceeds to pay off debts until the Player's income is greater than his/her expenses (a positive Monthly Cash Flow).

(c) Lose five consecutive turns.

If, after selling all the Player's assets, his/her Monthly Cash Flow is still negative, then ½ of his/her loans, not including Home Mortgage and School Loans, are wiped out along with ½ of the corresponding payments.

If the Player still has a negative Monthly Cash Flow, then he/she is officially out of the game.

Note: The following investments fall under "Business" in the "Asset" column: Automated Businesses, Limited Partnerships, Franchises and Other businesses. Similarly, the following investments fall under "Real Estate" in the Asset column: Residential Property, Apartments, Land, Bed & Breakfast and Malls.

Accuracy with accounting is vital for financial success. Playing this game teaches each Player the fundamental aspects of accounting. Also vital to financial success is calculated risk taking. Thus, the following Rule aspects of the game must be carefully followed:

Buying & Selling Investments

Buying A Real Estate Investment

If a Player buys a Real Estate Investment then he/she must follow these steps (refer to FIG. 15):

In the "Asset" column, under Real Estate, write in:

1) Type of real estate purchased

2) Down Payment

3) Cost of the real estate

In the "Liabilities" column, write in:

4) Type of real estate and the mortgage amount

In the "Income" column, under "Real Estate", write in:

5) Type of real estate

6) Amount of Cash Flow

On the right hand side of the Game Card, add or subtract:

7) Amount of Cash Flow to Passive Income

8) Amount of Cash Flow to Total Income

9) Amount of Cash Flow to Monthly Cash Flow

Selling A Real Estate Investment

If a Player sells a Real Estate Investment, then he/she must follow these steps (refer to FIG. 16):

1) Calculate the Settlement.

Settlement=Sales Price−Real Estate Mortgage

The Player receives the settlement in cash from the Bank. If this figure is negative, the Player must pay the amount to the Bank.

In the "Asset" column, under "Real Estate", remove:

2) Type of real estate purchased

3) Down Payment you paid

4) Cost of the real estate

In the "Liabilities" column, remove:

5) Type of real estate and the mortgage amount

In the "Income" column, under "Real Estate", remove:

6) Type of real estate

7) Amount of Cash Flow

On the right hand side of the Game Card, deduct:

8) Amount of Cash Flow from Passive Income

9) Amount of Cash Flow from Total Income

10) Amount of Cash Flow from Monthly Cash Flow

Buying Stocks/Mutual Funds/CDs

If a Player buys Stocks/Mutual Funds/CDs, then he/she must follow these steps (refer to FIG. 17):

In the "Asset" column, under Stocks/Mutual Funds/CD, write in:

1) Symbol of Stock/Mutual Fund

2) Number of shares purchased

3) Price per share (today's price)

If a dividend is being paid from the Stock/Mutual Fund, under the "Income" column, under Dividends, write in:

4) Symbol of Stock/Mutual Fund and the Dividend amount

If the dividend is being paid, on the right hand side of the Game Card, add:

5) Amount of Dividend to Passive Income

6) Amount of Dividend to Total Income

7) Amount of Dividend to Monthly Cash Flow

Selling Stocks/Mutual Funds/CDs

If a Player sells Stocks/Mutual Funds, then he/she must follow these steps (refer to FIG. 18):

1) Calculate the Sale Amount $$\text{Sale Amount}=\text{Number of Shares}\times\text{Selling Price}$$

Receive this amount in cash from the Bank

In the "Asset" column, under Stocks/Mutual Funds/CDs, remove:

2) Symbol of Stock/Mutual Fund

3) Number of shares purchased

4) Price per share

If the Stock/Mutual Fund/CD, under the "Income" column is paying a dividend, under "Dividends", remove:

5) Symbol of Stock/Mutual Fund/CD and the Dividend amount and on the right hand side of the Game Card, deduct:

6) Amount of Dividend from Passive Income

7) Amount of Dividend from Total Income

8) Amount of Dividend from Monthly Cash Flow

The Fast Track

A Player moves from the Rat Race to the Fast Track when his/her Passive Income is greater than his/her Total Expenses. A Player's goals on the Fast Track are to:

(1) Buy the Dream he/she chose at the start of the game by landing on the relevant space and purchasing the Dream.

(2) Buy other Players' Dreams, which eliminates them from the game.

(3) Increase his/her CashFlow Day Income by buying business investments on the Fast Track.

When a Player moves out of the Rat Race onto the Fast Track, he/she turns his/her reversible Game Card over and uses the side illustrated in FIG. 19 for further score keeping. He/she, at this time, receives from the Bank 100 times his/her Passive Income developed during play on the Rat Race track. This is the initial amount that the Player receives each time he/she lands on or passes CashFlow Day at the beginning of play on the Fast Track, but is subject to fluctuation as play continues.

Note: Why does the Player receive 100 times his/her Passive Income? The scenario is: In getting out of the Rat Race, the Player has sold all of his/her investments for great profits and has reinvested that money and had 10 years of outstanding investment success. Thus, the Player has increased his/her Passive Income 100 times.

The following information is entered on the Fast Track side of the Game Card:

(a) Names of Player & Auditor (b) Buyout (i.e., Beginning CashFlow Day Income)

(c) Beginning CashFlow Day Income (as a starting value)

To enter The Fast Track, the Player's playing piece is placed on the space denoted "Enter Here". Players on The Fast Track roll two dice unless later specified conditions allow or require more or fewer. "Opportunity" (Big Deal, Small Deal), "The Market" and "Doodads" cards no longer apply to Players who have entered The Fast Track.

CashFlow Day—Each time a Player lands on or passes CashFlow Day, he/she receives his/her CashFlow Day Income from the Bank. The Player does not have to ask for Income to receive it. If a Player forgets it on the turn he/she lands on or passes CashFlow Day, he/she may still receive it.

Business Investments—A Player may purchase any business investment on which his/her playing piece lands by paying the Down Payment listed. When a Player invests in a business, he/she should:

(a) Place one of his/her colored tokens on the space representing the business invested in.

(b) Add the business name, Monthly Cash Flow and New Total Income to his/her Game Card.

(c) Have his/her Auditor check the figures.

Dreams—Each time a Player lands on a "Dream" space, he/she may choose to purchase it if the player has the cash available. An identifying colored token is placed on each Dream a Player purchases.

Buying, by a given Player, that Player's selected Dream: If a Player buys the Dream he/she selected at the start of the game, then that Player cannot be eliminated from the game. A Player must buy his/her Dream in order to win the game.

Buying Other Players' Dreams: If a Player purchases a Dream another Player has selected, then that other Player is eliminated from the game. If no other Player has selected a "Dream" space a Player lands on, that Player can still buy that Dream just for fun.

Charity—Charity is optional. If a Player lands on a "Charity" space, he/she may pay $100,000 then that Player may roll 1, 2 or 3 dice on each turn. The Player may select a different number of dice to roll on each turn.

Life on the Fast Track is not all roses; thus:

Tax Audit—Player who lands on "Tax Audit" must pay out ½ of his/her cash.

Divorce—A Player who lands on "Divorce" loses all his/her cash.

Lawsuit—If a Player lands on "Lawsuit", the cost is $100,000.

Playing the subject game as set forth above teaches the fundamentals of personal finance and investing, the relevant aspects of accounting and the principles behind the accumulation of wealth including the attainment of significant passive income. It has been found that a Player becomes more skillful in playing the game, and hence improves his/her understanding of the principles of realizing wealth, by playing the game repeatedly, preferably with like minded individuals as the other Players. Each game takes about three hours to play from beginning to end, and during the course of a single game, years of financial activity are compressed into a single evening of enjoyment.

Accordingly, the basic aspects of personal finance, investing and accounting are effectively taught by playing a board game wherein a players game card is an integrated income statement/balance sheet and provides a visual and intellectual understanding of the player's financial future, as simulated during game play, by displaying an integrated accounting of the player's cash flow such that:

A) if the integrated income statement/balance sheet shows work income and expenses, but limited income producing assets and limited liabilities, the player is tending, in the simulation, to work for life to meet ongoing expenses and to have few resources late in life, thereby suffering a low standard of living;

B) if the integrated income statement/balance sheet shows work income, liabilities and expenses, but limited income producing assets, the player is tending, in the simulation, to work for life to meet ongoing expenses and to pay off liability obligations in order to have some resources late in life, thereby having a middle class standard of living; and C) if the integrated income statement/balance sheet shows assets that generate sufficient income to cover expenses, the player is tending, in the simulation, to achieve significant and increasing wealth.

While the game has been presented in this specification as played on a physical board using physical dice, tokens, cards, etc., it will be understood that it is readily adaptable to a computer environment provided on a floppy disk, CD ROM or other suitable medium. Further, in such an embodiment, the game can be played by Players at diverse locations via a local area network, wide area network or an extended network such as the Internet. Accordingly, the various terms employed in the above description to identify physical components, such as "board", "tokens", "dice", "cards", "tracks", etc. should be taken to include electronic media equivalents.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

What is claimed is:

1. A game for teaching financial skills to players, said game comprising:

A) a set of individual financial statements for distribution, one each of said individual financial statements to each player, at the beginning of a game;

B) indicia carried by the individual financial statement associated with each player, the indicia of a financial statement assigning a specified initial periodic income and specified initial periodic expenses ascribed to the associated player, the financial statement reflecting periodic income, passive income, expenses, assets and liabilities of the player and being selectively revisable by the associated player to reflect the effects of game events, said periodic income corresponding to an income from a profession, said passive income corresponding to income from interest, dividends, real estate and businesses;

C) indicia of a first set of events comprises indicia of opportunities to participate in specified transactions which include receiving interest, dividends, real estate and businesses, said indicia of a first set of events applicable to players having passive income less than a predetermined percentage of the player's expenses, each of said first set of events potentially affecting at least one of the periodic income, passive income, expenses, assets and liabilities of the player;

D) indicia of a second set of events applicable to players having achieved passive income greater than a predetermined percentage of the player's expenses, each of said second set of events potentially affecting at least one of the periodic income, passive income, expenses, assets and liabilities of the player; and E) means for pseudo-randomly designating, in turn, a respective particular game event from the first set of events for each respective player who currently has passive income less than a predetermined percentage of the player's expenses, and a respective particular game event from the second set of events for each respective player who has previously achieved a passive income greater than a predetermined percentage of the player's expenses.

2. The game of claim 1 wherein the individual initial financial statements each comprises an individual card of a set of cards provided for distribution to the players at the beginning of a game.

3. The game of claim 2 wherein each card designates a profession for the player receiving the card.

4. The game of claim 1 wherein the financial statement comprises an income statement and balance sheet.

5. The game of claim 1 wherein the financial statement includes revisable indicia of cash flow.

6. The game of claim 1 wherein the financial statements includes revisable indicia of savings.

7. The game of claim 1 further including revisable indicia of cash on hand.

8. The game of claim 1 wherein the financial statement includes indicia of a profession ascribed to a player.

9. The game of claim 1 wherein the indicia of the first set of events comprises indicia of a plurality of selectable subsets of events, each subset associated with a respective category of event.

10. The game of claim 9 wherein one category of events corresponds to the opportunity to participate in transactions requiring an investment in an amount less than a predetermined amount, and a second category of events corresponds to the opportunity to participate in transactions requiring investment in an amount greater than the predetermined amount.

11. The game of claim 9 wherein one category of the events corresponds to the opportunity to sell a specified asset at a specified price.

12. The game of claim 9 wherein one category of the events corresponds to the opportunity for all players having a specified asset to sell the specified asset at a specified price.

13. The game of claim 9 wherein one category of the events corresponds to changes in the periodic expenses to be ascribed to a player.

14. The game of claim 1 wherein the indicia of the first set of events comprises at least one set of cards, each card representing an event.

15. The game of claim 14 wherein the indicia of the first set of events comprises a plurality of sets of cards, each set of cards associated with a different category of the events, each card in a set of cards representing an event in the associated category.

16. The game of claim 14 wherein the means for pseudo-randomly designating comprises a pseudo-random number generator.

17. The game of claim 16 wherein the pseudo random number generator comprises at least one die.

18. The game of claim 1 wherein the means for pseudo-randomly designating comprises a first sequence of event designators, at least some of said designators in said first sequence corresponding to the occurrence of one of said first set of events, and a second sequence of event designators, at least some of said designators in said second sequence corresponding to the occurrence of one of said second set of events.

19. The game of claim 18 wherein the sequences of event designators comprises first and second separate tracks on a game board, each of said first and second tracks having sequential spaces, each sequential space carrying indicia of an event.

20. The game of claim 1 wherein the means for pseudo-randomly designating comprises a game board and a pseudo-random number generator.

21. The game of claim 20 wherein the pseudo random number generator comprises at least one die.

22. The game of claim 21 wherein the game board includes first and second separate tracks, each of said first and second tracks having sequential spaces, at least some spaces of said first track of sequential spaces reflecting the occurrence of one of said first set of events, and at least some spaces of said second track of sequential spaces reflecting the occurrence of one of said second set of events.

23. The game of claim 1 wherein the indicia of a second set of the events comprises a track of sequential spaces, at least some of said spaces in said track of sequential spaces reflecting the occurrence of one of said second set of events.

24. A method of playing a game for teaching financial skills to players comprising the steps of:

A) providing a set of individual financial statements;

B) distributing one financial statement to each player at the beginning of a game;

C) providing financial information indicia with the financial statement associated with each player, the financial statement assigning a specified initial periodic income and specified initial periodic expenses ascribed to the associated player, the financial statement reflecting periodic income, passive income, expenses, assets and liabilities of the player and being selectively revisable by the associated player to reflect the results of game events, said periodic income corresponding to an income from a profession, said passive income corresponding to income from interest, dividends, real estate and businesses;

D) providing indicia of a first set of events comprises indicia of opportunities to participate in specified transactions which include receiving interest, dividends, real estate and businesses, said indicia of a first set of events applicable to players having passive income less than a predetermined percentage of the player's expenses, each of the first set of events potentially affecting at least one of the periodic income, passive income, expenses, assets and liabilities of the player;

E) providing indicia of a second set of events applicable to players having achieved passive income greater than a predetermined percentage of the player's expenses, each of the second set of events potentially affecting at least one of the periodic income, passive income, expenses, assets and liabilities of the player; and F) playing the game in the following manner:

(a) pseudo-randomly designating, in turn, a respective particular game event from the first set of events for each respective player who currently has passive income less than a predetermined percentage of the player's current periodic expenses, and a respective particular game event from the second set of events for each respective player who has previously achieved a passive income greater than a predetermined percentage of the player's current periodic expenses;

(b) revising the indicia of the financial statement of each player in accordance with the financial effects of each game event on that player; and (c) repeating steps (a) and (b) until at least one player attains a predetermined goal.

25. The method of claim 24 wherein the predetermined goal comprises a predetermined financial condition.

26. The method of claim 24 wherein the step of ascribing specified initial periodic income and expenses comprises the step of ascribing to each player a respective profession, each profession having an initial salary and initial periodic expenses associated therewith.

27. The method of claim 24 wherein the indicia of a first set of events comprises at least one set of cards, each card representing an event.

28. The method of claim 24 wherein the indicia of a first set of events comprises a plurality of sets of cards, each set of cards associated with a different category of the events, each card in a set of cards representing an event in the associated category.

29. The method of claim 28 further comprising:

A) selecting a respective token corresponding to each player,

B) providing a game board including first and second separate closed tracks each having sequential spaces, at least some of the spaces corresponding to the occurrence of the respective categories of the events, and C) wherein the step of pseudo-randomly designating, for respective players having passive income less than a predetermined percentage of the individual players' expenses, their respective exposure to an event from the first set of the events comprises the steps of:

(a) pseudo-randomly ascribing a number to an individual player;

(b) advancing the token corresponding to the individual player along the track of spaces in accordance with the number; and (c) distributing to the individual player a card from the set of cards corresponding to the category, if any, associated with the space on which the token lands.

30. The method of claim 24 in which the indicia of the first set of events comprises a set of cards, each card reflecting one event of the first set of events.

31. The method of claim 30 in which the game is played on a game board carrying the first and second closed tracks of sequential spaces, and the step of pseudo-randomly designating comprises the step of rolling at least one die.

* * * * *